United States Patent [19]

Hawkins

[11] Patent Number: 4,673,366

[45] Date of Patent: Jun. 16, 1987

[54] EXPOSURE SUIT WITH AN ATTACHED LIFEJACKET

[75] Inventor: James M. Hawkins, Huntington, England

[73] Assignee: BTR PLC, London, England

[21] Appl. No.: 804,105

[22] Filed: Dec. 3, 1985

[30] Foreign Application Priority Data

Dec. 5, 1984 [GB] United Kingdom ..... 8430726

[51] Int. Cl.[4] ..... B63C 9/16

[52] U.S. Cl. ..... 441/90; 441/102; 441/116; 441/118

[58] Field of Search ..... 441/90, 91, 92, 102, 441/106, 111–118

[56] References Cited

U.S. PATENT DOCUMENTS

| | | | |
|---|---|---|---|
| 2,005,460 | 6/1935 | Fried | 441/102 |
| 2,362,962 | 11/1944 | Bingham | 441/90 |
| 2,521,205 | 9/1950 | David | 441/102 |
| 2,615,182 | 10/1952 | Podell | 441/113 |
| 2,782,430 | 2/1957 | Radnofsky | 441/104 |
| 4,533,335 | 8/1985 | Hoshino | 441/102 |

FOREIGN PATENT DOCUMENTS

| | | | |
|---|---|---|---|
| 546082 | 1/1942 | United Kingdom . | |
| 941150 | 11/1963 | United Kingdom | 441/92 |
| 2068846 | 8/1981 | United Kingdom | 441/113 |

*Primary Examiner*—Sherman D. Basinger
*Assistant Examiner*—Stephen P. Avila
*Attorney, Agent, or Firm*—Fleit, Jacobson, Cohn & Price

[57] ABSTRACT

An exposure suit 10 has an attached lifejacket (14) which includes a part-annular rear portion (17) within a sheath (26) secured across the back of the shoulders of the suit 10 and a front portion 16 which is secured at (19) to the chest center of the suit. In a stowed deflated condition (FIG. 1) the portion (16) is folded or rolled to form a package restrained by a restraint such as a flap 31 on one side of a suit fastener (12), inflation of the lifejacket causing it to release its restraint and automatically to adopt a position overlying the chest of the suit (10) and wearer in a body supporting position.

19 Claims, 8 Drawing Figures

EXPOSURE SUIT WITH AN ATTACHED LIFEJACKET

This invention relates to an exposure suit for wear by a person who is exposed to the danger of immersion, for example during work or during travel.

The invention particularly concerns an exposure suit for wear by a person travelling over water by helicopter, for example between a land base and an oil rig or the like. Because such helicopters fly at relatively low altitude, there is very little time, in the event of engine failure or other mishap, for the occupants to don protective clothing before immersion. For this reason it is normal for each occupant to wear a one-piece immersion or exposure suit, including integral hood and boots, at all times during such flights. Because the helicopter is heated, such a suit would become intolerably uncomfortable if worn closed and is usually unzipped to the waist allowing air circulation. The wearer is provided with a life jacket in a lap-pouch. When an emergency arises the wearer must close the suit front, don the lifejacket and secure it about his upper body. The time available is not always sufficient and swift action may well be hampered by aircraft violent movement and the effects of shock or panic. It is an object of the present invention to provide a suit which has a lifejacket attached to it in a ready-for-use position which allows the wearer to travel with the suit unfastened for comfort, and which can be speedily deployed in an emergency.

Accordingly the invention provides an exposure suit provided with an inflatable lifejacket having a rear portion disposed across the back of the neck and shoulders of the suit and a front portion attached centrally to the chest of the suit, the front portion being normally deflated and restrained to form a package overlying a chest portion of the suit on one side of a front opening thereof, actuation of an inflator of the lifejacket causing the front portion to overcome its restraint and deploy as an inflated body extending across the chest of the suit.

A preferred suit can be constructed to have one or more of the following features:

(a) The inflator is a cylinder of compressed gas connected by a valve to the interior of the lifejacket.

(b) The inflator is a mouth-tube or a manual pump.

(c) The lifejacket consists of a single inflatable chamber having said front and rear portions.

(d) An inner wall of the lifejacket is detachably secured to the chest of the suit along a line extending along the centre of the suit chest, the suit front opening being offset to one side to accommodate this feature.

(e) The aforesaid securement is a releasable fastening.

(f) The releasable fastening is a loop and tape arrangement.

(g) The rear portion of the lifejacket is generally part-annular.

(h) The rear portion of the lifejacket is accommodated within an expandable sheath secured across the back of the shoulders of the suit.

(i) The front portion of the lifejacket is restrained by a flap attached permanently to the suit along one side and attached releasably along the otherside.

(j) The front portion of the lifejacket is restrained by releasable or frangible straps, or by a frangible bag.

(k) The front portion of the lifejacket is rolled or folded or crumpled to form said package.

(l) The rear portion of the lifejacket is detachably secured within the sheath.

The invention will be described further by way of example, with reference to the accompanying sketches, wherein.

Figure 3:
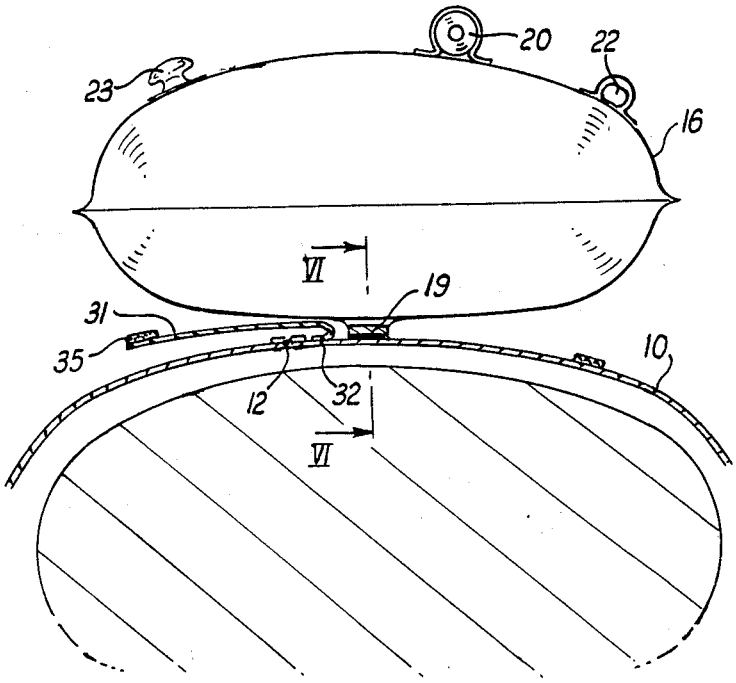
FIG. 3 is a fragmentary cross sectional view on line III—III of FIG. 7.
Figure 6A:
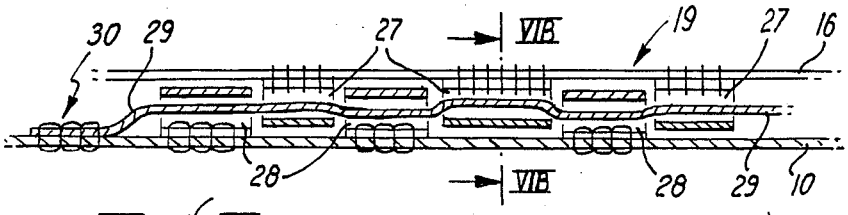
Figure 6B:
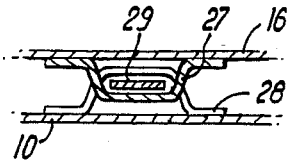

FIG. 6*a* is an enlarged longitudinal cross-sectional view on the line VI—VI of FIG. 3;

FIG. 6*b* is a cross-section on line VIB—VIB of FIG. 6*a;* and

Figure 7:
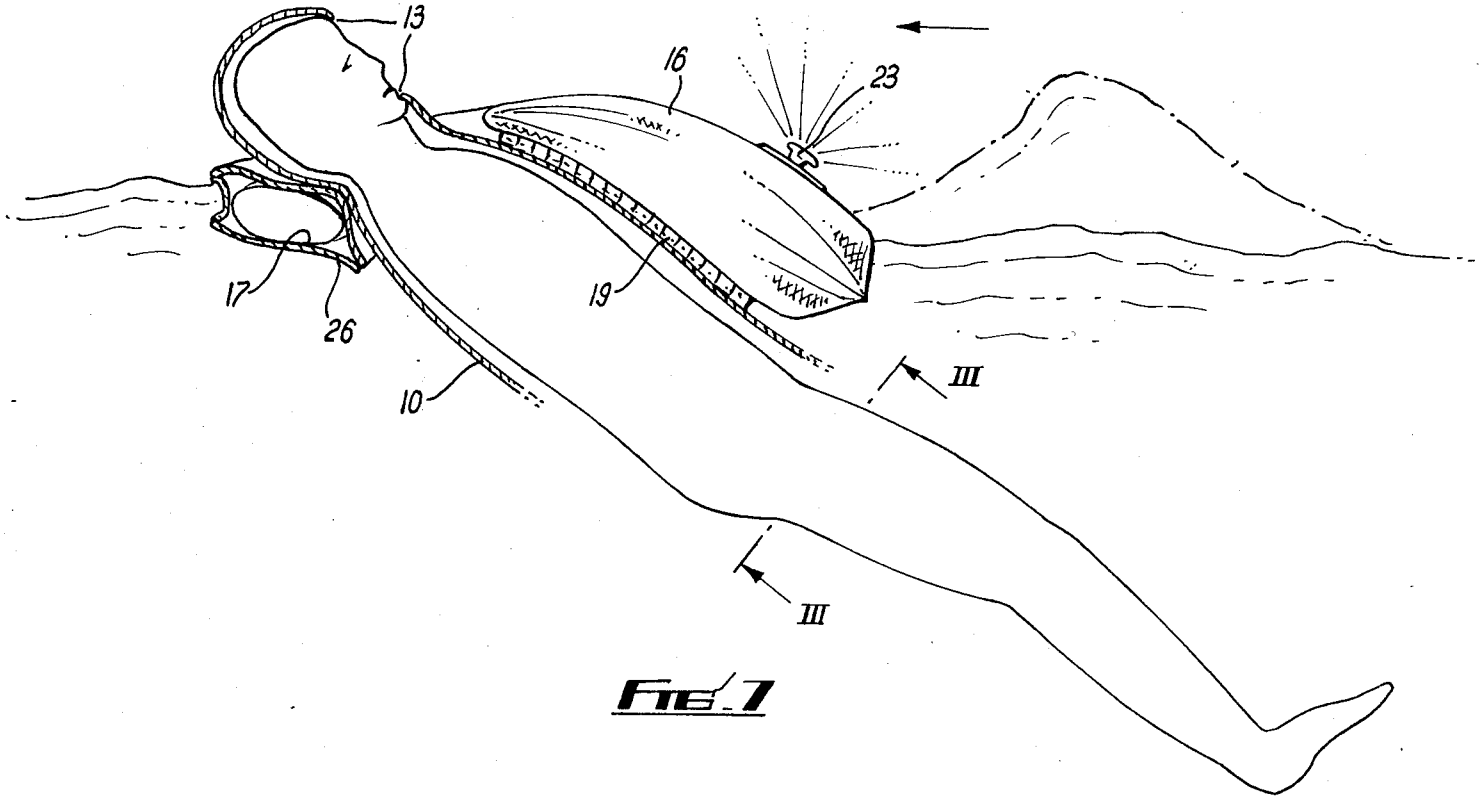

FIG. 7 is a longitudinal cross-sectional view showing a wearer and the suit in use.

A preferred embodiment of suit 10 of the invention is made from waterproofed fabric and is of boiler suit type being capacious, to fit all sizes of wearers, or sized to meet a range of user sizes eg S,M,L or EXL, and including integral overboots (not shown). Sleeves 11 of the suit can have elasticated wrist bands and/or integral gloves (not shown) if desired. A sliding clasp fastener 12 extends from crotch to chin to allow entry and an integral hood, including or consisting of foamed neoprene can form a ring seal at 13 with the periphery of the wearer's face. Thus a wearer of the closed suit is substantially totally enclosed and protected against cold and wet.

Figure 5:
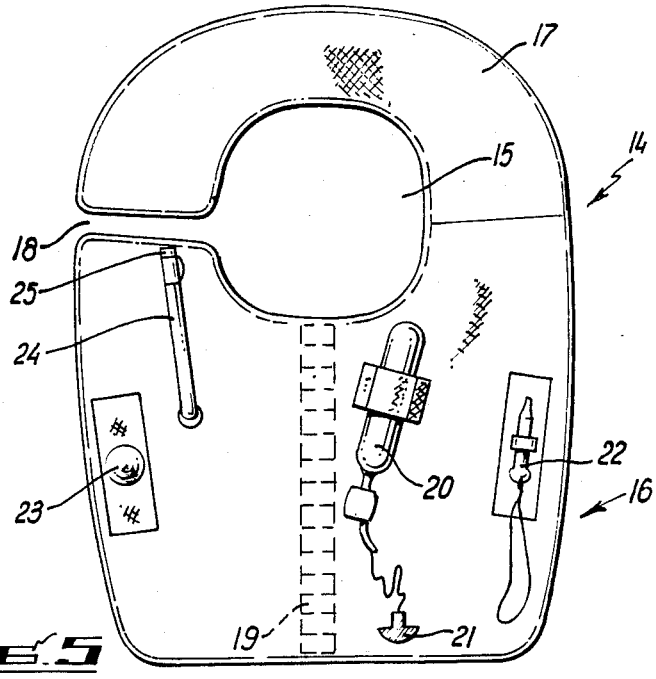
FIG. 5 is a front view of the lifejacket separated from the suit.
Figure 4:
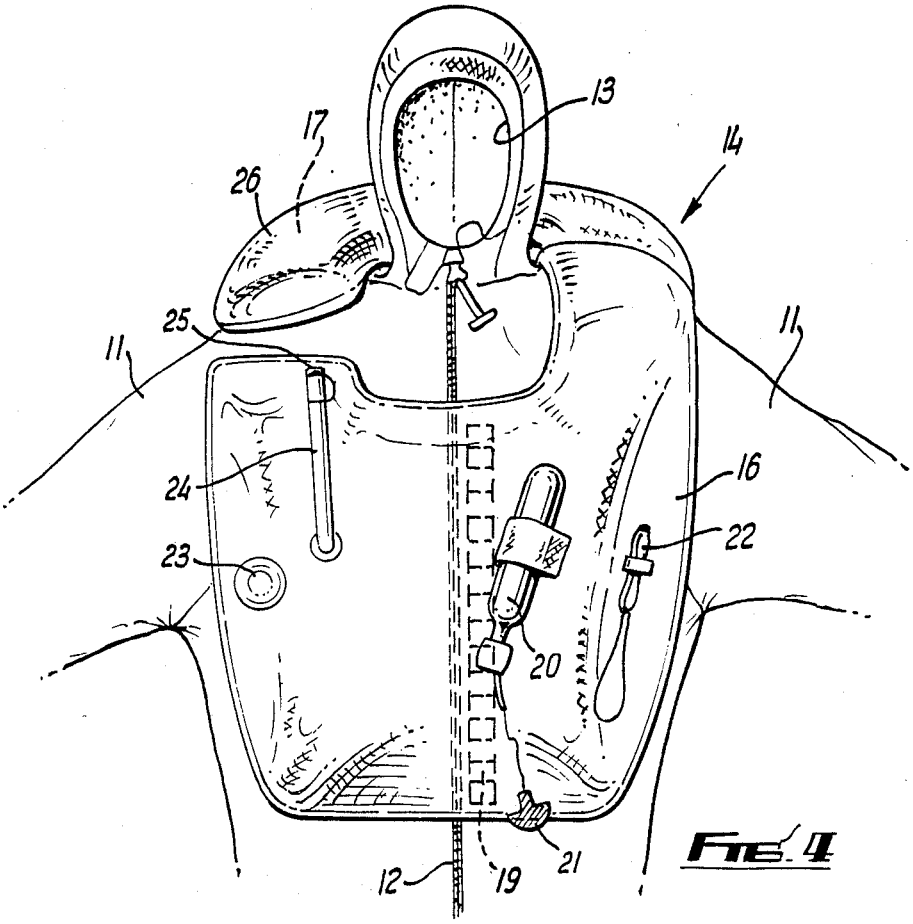
FIG. 4 is a view similar to that of FIG. 1 but with the lifejacket deployed.

There is attached to the suit 10 a lifejacket 14 which is shown separate in front elevation in FIG. 5. The lifejacket 14 consists of a pair of panels of fluid impermeable fabric secured together at their peripheries. The lifejacket 10 is similar to a conventional lifejacket having a central neck aperture 15, a generally rectangular front portion 16 and an arcuate rear portion 17. The major difference from a conventional lifejacket is the provision of the gap at 18 which allows storage as will be later described. The inner or rear panel of the front portion had fastening means 19 of a type and for a purpose later described. The front of the lifejacket carries conventional fittings such as a cylinder of compressed gas 20 for inflation, operable by a pull-handle 21, a whistle 22, a lamp 23 and a mouth-operable inflator in the form of a tube 24 connected to the interior of the lifejacket 14 and having a non-return valve and a closure cap 25.

Secured to the rear of the shoulders of the suit 10 is a protective expansible sheath 26 whose inner wall is permanently secured to the suit material as by welding, adhesion or sewing and which can accommodate the portion 17 of the lifejacket in the flat deflated condition or in the expanded inflated condition. Press-studs (not shown) or similar releasable fastenings can attach the portion 17 to the interior of sheath 26. Portion 17 is thus protected from wear in use.

The front opening of the suit 10, closable by fastener 12 is offset slightly to the wearer's right (best seen in FIG. 3) and the rear panel of lifejacket 14 is secured to the chest centre line of the suit by fastening 19 best seen in FIGS. 6*a* and 6*b*. The fastening 19 includes a series of spaced tape loops 27 sewn to the portion 16 of lifejacket 14 at spaced intervals and an interdigitating series of corresponding loops 28 sewn to the chest of suit 10. A tape 29 as attached to suit 10 at 30 and interlaced with the loops and secured at its free end. There is thus a firm linear attachment along the chest centre line which can be released when the lifejacket has to be removed for replacement or servicing.

Figure 1:
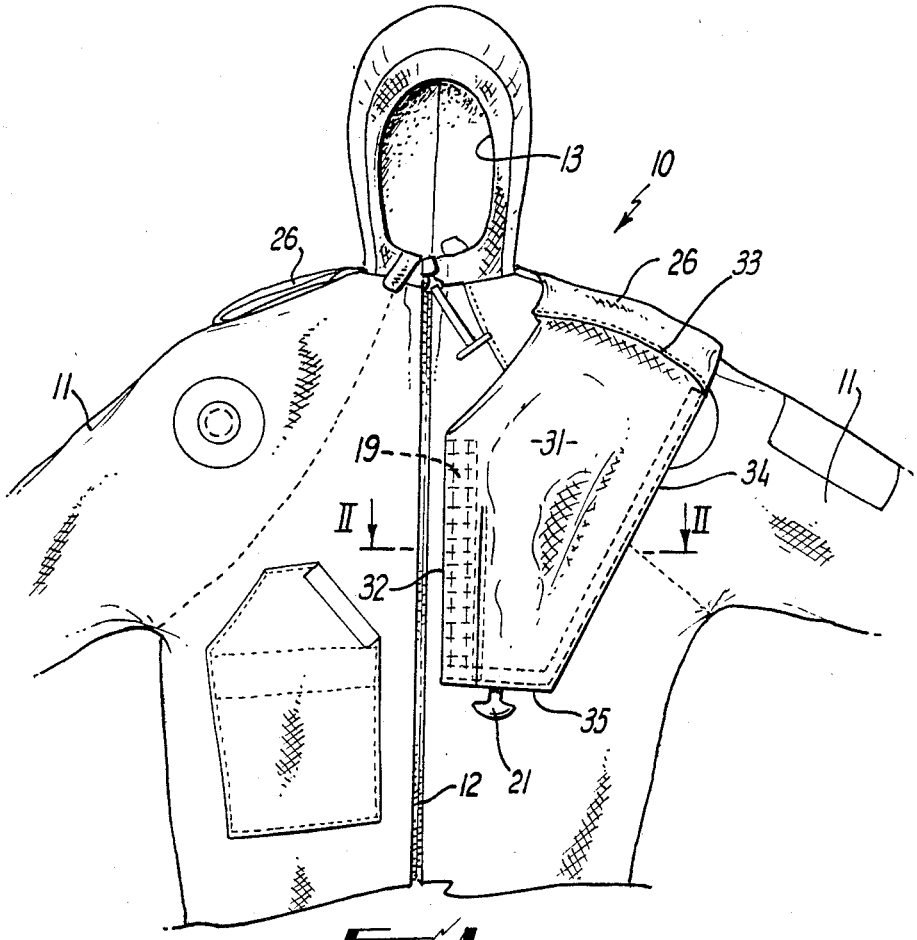
FIG. 1 is a front view of a preferred suit of the invention; with its lifejacket stowed.
Figure 2:
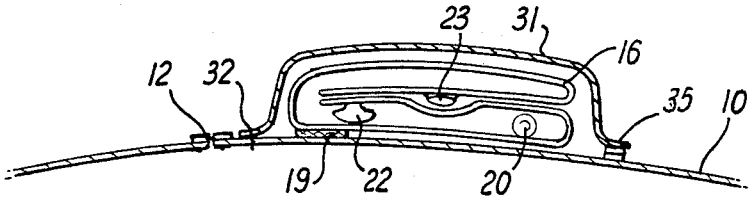
FIG. 2 is an enlarged cross section on line II—II of FIG. 1.

A flap 31 of protective fabric is secured by its inner edge 32 to the suit on the wearers left chest side of the fastener 12 and in the stowed condition (FIGS. 1 and 2) overlies the portion 16 which is folded to form a package beneath flap 31. The portion 16 can be rolled or crumpled or otherwise "compressed" in its stored position if desired. The free edges 33, 34, 35 are attached to the chest of the suit 10 by hook and pile fastener strips which are sufficiently strong to restrain the folded portion 16 in the stowed condition, but are easily rendered in operative by inflation by the inflator cylinder 20. After deployment flap 31 overlies the right chest of the suit beneath the portion 16 (FIG. 3).

The suit 10 in combination with attached lifejacket 14 provides a conveniently wearable suit which allows the wearer comfort and eliminates time consuming operations when it is used. The storage on one side of fastener 12 enables fastener 12 to be operated instantly without hindrance and once in the water pulling of handle 21 inflates the lifejacket and deploys it to a correct body-supporting position. A "divided-front" lifejacket, having two lobes one on each side of fastener 12, would give the feature of unimpeded fastener operation, but would have two disadvantages. Firstly, a wearer of such a lifejacket might not have a "self-righting" buoyancy configuration, and if unconscious or weakened, might be held in a fatal face-down position. Secondly, when the wearer of such a suit is immersed the wearers submerged feet and legs (FIG. 7) act as a sea anchor and the wearers face is directed into the wind and waves, whose direction is indicated by the arrow. A divided-front lifejacket would allow waves to channel directly onto the wearers face making breathing difficult if not impossible. A unitary inflated bag 16 overlying the chest has the secondary effect of forming a breakwater protecting the wearer's face from all or most waves and thus increasing his comfort and chances of survival.

The suit of the invention has improved buoyancy characteristics compared to a simple exposure suit which may well have sufficient buoyancy to support a wearer, for example by its intrinsic properties or by entrapped air, but whose buoyancy may well be distributed evenly, causing a wearer to float generally horizontally when at rest. With such a suit, an inert, e.g. weak or unconscious, wearer floating face-downwards would be in a stable configuration and drowning could easily occur. With the suit of the invention, the large chest-front buoyancy makes a "face-down" configuration highly unstable, and thus an inert wearer would be automatically righted from a face-down position with consequently greater chances of survival.

The invention is not limited to the precise details of the foregoing and variations can be made within the scope of the following claims. For example, an anti-spray hood can be fitted to the rear pouch which can be unfolded and attached to the inflated front lobe to give additional protection against spray.

I claim:

1. An exposure suit comprising:

a suit constructed of flexible protective material and having a neck portion, shoulder portions, a waist portion and a chest portion, each said portion, in use, overlying a corresponding body part of a wearer, a linear sealable front opening located in said chest portion and extending between said neck portion and said waist portion, a life jacket secured to said suit, said life jacket including a rear inflatable portion overlying said shoulder portions and a rear part of said neck portion and a front inflatable portion secured to said chest portion at least at a central part thereof and being located on only one side of said sealable front opening, restraining means for restraining said front inflatable portion in a deflated condition to form a package overlying a part of said chest portion on said one side of said sealable front opening so as to leave said sealable front opening fully operational whilst said front inflatable portion is in said deflated condition, inflation means for inflating said inflatable portions, and said front inflatable portion, in an inflated condition forms a buoyancy body overlying both sides of said sealable front opening and having a center overlying a central portion of said chest portion.

2. An exposure suit as set forth in claim 1, wherein said rear inflatable portion and said front inflatable portion are integral and formed within a common envelope of gas impermeable material.

3. An exposure suit as set forth in claim 1, wherein said life jacket includes an envelope enclosing said rear inflatable portion and said front inflatable portion, said rear inflatable portion and said front inflatable portion being separately inflatable.

4. An exposure suit as set forth in claim 1, wherein said life jacket is detachably secured to said chest portion along a line extending along a median center line of said chest portion, said sealable front opening being offset to one side of said median center line.

5. An exposure suit as set forth in claim 4, wherein said life jacket is detachably secured by a releasable fastening located between said life jacket and said chest portion.

6. An exposure suit as set forth in claim 5, wherein said releasable fastening is a loop and tape arrangement.

7. An exposure suit as set forth in claim 1, wherein said rear inflatable portion is part-annular.

8. An exposure suit as set forth in claim 1, wherein said rear inflatable portion is located within an expandable sheath to said suit.

9. An exposure suit as set forth in claim 1, wherein said restraining means includes a flap having two sides and being attached permanently to said suit along one side and releasably attached to said suit along the other side.

10. An exposure suit as set forth in claim 1, wherein said restraining means are straps.

11. An exposure suit as set forth in claim 1, wherein said front inflatable portion is compressed to form said package.

12. An exposure suit as set forth in claim 1, wherein said rear inflatable portion is detachably secured within said sheath.

13. An exposure suit comprising:

a suit constructed of flexible protective material and having a neck portion, shoulder portions, a waist portion and a chest portion, each said portion, in use, overlying a corresponding body part of a wearer, a linear sealable front opening located in said chest portion and extending between said neck portion and said waist portion, a life jacket secured to said suit on one side of said sealable front opening, said life jacket including a rear inflatable portion overlying said shoulder portions and a rear part of said neck portion and a front inflatable portion detachably secured to said chest portion along a line extending along a median center line of said chest portion, restraining means for restraining said front inflatable portion in a deflated condition to form a package overlying a part of said chest portion on said one side of said sealable front opening so as to leave said sealable front opening fully operational whilst said front inflatable portion is in said deflated condition, inflation means for inflating said inflatable portions, and said front inflatable portion, in an inflated condition forms a buoyancy body overlying both sides of said sealable front opening and having a center overlying a central portion of said chest portion.

14. An exposure suit as set forth in claim 13, wherein said life jacket is detachably secured by a releasable fastening located between said life jacket and said chest portion.

15. An exposure suit as set forth in claim 13, wherein said rear inflatable portion is located within an expandable sheath secured to said suit.

16. An exposure suit as set forth in claim 13, wherein said restraining means includes a flap having two sides and being attached permanently to said suit along one side and releasably attached to said suit along the other side.

17. An exposure suit as set forth in claim 13, wherein said restraining means are straps.

18. An exposure suit as set forth in claim 13, wherein said front inflatable portion is compressed to form said package.

19. An exposure suit as set forth in claim 13, wherein said rear inflatable portion is detachably secured within said sheath.

* * * * *